US012808609B2

(12) United States Patent
Dränkow et al.

(10) Patent No.: US 12,808,609 B2
(45) Date of Patent: Nov. 24, 2026

(54) HEAT EXCHANGER WITH AT LEAST TWO DIFFERENT PLATES

(71) Applicant: MAHLE INTERNATIONAL GMBH, Stuttgart (DE)

(72) Inventors: Andreas Dränkow, Heimsheim (DE); Thomas Merten, Knittlingen (DE); Dominik Behnert, Leonberg (DE)

(73) Assignee: MAHLE International GmbH, Stuttgart (DE)

( * ) Notice: Subject to any disclaimer, the term of this patent is extended or adjusted under 35 U.S.C. 154(b) by 186 days.

(21) Appl. No.: 18/639,067

(22) Filed: Apr. 18, 2024

(65) Prior Publication Data

US 2024/0353185 A1 Oct. 24, 2024

(30) Foreign Application Priority Data

Apr. 21, 2023 (DE) ..... 102023110223.0

(51) Int. Cl.
*F28F 3/08* (2006.01)
*F28D 7/00* (2006.01)
*F28D 21/00* (2006.01)

(52) U.S. Cl.
CPC ..... *F28F 3/08* (2013.01); *F28D 7/0075* (2013.01); *F28D 21/00* (2013.01); *F28D 2021/008* (2013.01)

(58) Field of Classification Search
CPC .... F28F 3/08; F28D 9/005; F28D 2021/0089; F28D 9/0093
See application file for complete search history.

(56) References Cited

U.S. PATENT DOCUMENTS

| | | | | |
|---|---|---|---|---|
| 5,222,551 | A | 6/1993 | Hasegawa et al. | |
| 8,061,416 | B2 | 11/2011 | Geskes et al. | |
| 10,591,220 | B2 | 3/2020 | Bluetling | |
| 11,867,469 | B2 * | 1/2024 | Dahlberg ..... | F28F 3/046 |
| 2007/0261834 | A1 | 11/2007 | Yang et al. | |

FOREIGN PATENT DOCUMENTS

| | | |
|---|---|---|
| CN | 111964495 | 11/2020 |
| DE | 102004036951 | 5/2005 |
| EP | 4148367 | 3/2023 |

OTHER PUBLICATIONS

English translation of Office Action issued in DE102023110223.0 (Dec. 8, 2023).

* cited by examiner

*Primary Examiner* — Jon T. Schermerhorn, Jr.
(74) *Attorney, Agent, or Firm* — Barnes & Thornburg

(57) ABSTRACT

A heat exchanger, preferably for a motor vehicle, is provided and includes a stacking direction, at least one first plate, at least one second plate. The at least two plates are adjacent to one another or on top of one another in the stacking direction. The at least two plates each have a base plane. The at least two plates each have a plane offset and parallel to the base plane. The first offset plane is raised above the first plate in the stacking direction. The second offset plane is recessed in the stacking direction. There are always a first plate and second plate that are stacked in an alternating sequence in the stacking direction, such that the base planes and offset planes (E1, E1) of the at least two plates bear on one another and are joined to one another.

16 Claims, 7 Drawing Sheets

HEAT EXCHANGER WITH AT LEAST TWO DIFFERENT PLATES

CROSS-REFERENCE TO RELATED APPLICATIONS

This application claims priority from German Patent Application No. DE 102023110223.0, filed Apr. 21, 2023, the entirety of which is hereby incorporated by reference herein.

The invention relates to a heat exchanger made of two types of plates, and the use of the heat exchanger in a motor vehicle.

DE 10 2004 036 951 A1 describes a heat exchanger made of plates that are adjacent to or on top of one another and joined together. Hollow chambers that are sealed off from the exterior are formed between the plates, through which a first and second medium flow in an alternating sequence via two first openings (forming an intake and an outlet). The plates between the cover plates are identical. The plates are structured (corrugated). These structures form grooves between the corrugations. The structures (corrugations) form contacts between adjacent plates. The contacts are formed at the bottoms of the adjacent plates. The plates are joined to one another at these contact points. The structures are such that the first and second media do not flow from the first holes to the second holes in a straight line. This results in turbulences in the first and second media. The structures also increase the surface area of each plate. This increase in surface area increases the capacity of the heat exchanger, because there is more surface area with which heat can be exchanged. Each plate has two first openings and two second openings (a pair of holes for the intake and outlet for the first and second medium). The second openings have a raised area. The plates have a raised circumferential rim. Adjacent plates are joined to one another at the rim and the raised areas. This seals off the hollow chambers between two adjacent plates from adjacent hollow chambers in a fluid-tight manner. The plates are stacked between a lower cover plate and an upper cover plate. The plates are stacked in opposing orientations, rotated 180° to one another. This results in two separate paths for the two media. The strength of the plates is determined by the flat regions adjacent to the openings. These regions are unstructured. When the plates are subjected to loads, these regions can become warped. The flat regions are subjected to the pressure of the media. These media normally exert different pressures. This difference in pressures also acts on the flat regions next to the openings. To obtain plates of sufficient strength, the plates must be made thicker than otherwise necessary. This thickness dictates how thick the material that is used needs to be. Thickness can also be regarded as an indication of strength. It may also be necessary to increase the thickness of the upper and lower cover plates in order to reinforce the plates between them. This has the disadvantage that more material must be used. The two media can flow in a direction that is diagonal or parallel to the lateral direction of the plates. It is not possible to divert a medium from one level to another, i.e. between the plates, without additional components such as tubes or return channels. This has disadvantages with regard to the design of the flow paths for the media.

The capacity of a heat exchanger can be increased by enlarging the plates or increasing the volumetric flow of the media. Increasing the volumetric flow also has disadvantages in that it increases the pressure losses in the flow paths. The heat exchanger couples a refrigerant circuit to a coolant circuit. The resulting pressure losses have a substantial effect on the behavior of the coolant circuit. These pressure losses result in an undesired change in temperature or pressure in the media (refrigerant and coolant).

The device according to the invention, which has the features of the independent claim has the advantage that the plates in the heat exchanger are very robust, while the thickness of the plates can potentially be reduced, and there is more flexibility with regard to the shape of the flow paths for the medium, thus increasing the capacity of the heat exchanger or reducing the pressure losses.

The basis of the invention is a heat exchanger made of plates that can preferably be used in a motor vehicle. The heat exchanger according to the invention contains a stack of at least one first plate and at least one second plate. The at least two plates are adjacent to or on top of one another in the stacking direction. The at least two plates each have a base plane. The at least two plates each have an offset plane that is parallel to the base plane. The first offset plane of the first plate is raised in the stacking direction. The second offset plane is recessed. The plates can be made of an aluminum alloy or stainless steel. The at least two plates can be produced with a stamping process or through deep drawing. Adjacent plates can be material-bonded to one another, e.g. through brazing or welding. Hollow chambers are formed between adjacent plates. These hollow chambers are sealed off from one another in a fluid-tight manner. This means that no media, or very little, can pass through the bonds.

Two different media can flow through the heat exchanger according to the invention. The base plane can have at least two first openings through which a first media can pass. The offset planes can each have at least two second openings through which a second medium can pass. A first medium can enter and exit a hollow chamber between two adjacent plates through the at least two first openings, and a second medium can enter and exit a hollow chamber between two adjacent plates through the at least two second openings.

Structures are formed on the at least two plates. The first structure on the first plate extends upward in the stacking direction. The second structure on the second plate extends downward in the stacking direction. These structures can form grooves obtained with a corrugated structure. Alternatively, the structures can be formed by nubs or cones. This advantageously increased the surface area of the plates through which heat is exchanged. Two adjacent plates can be joined to one another at these structures. This results in channels formed in the hollow chambers between adjacent plates.

The stack is formed by alternating plates, such that the flat regions of the base planes and the offset planes of adjacent plates bear against one another. These base planes and offset planes can be materially bonded to one another. This is possible because the first offset plane on a first plate is raised, and the second offset plane on a second plate is recessed. Two media can flow through the heat exchanger according to the invention in two different flow paths. The two media can be at different pressures. The strength of each plate depends largely on the flat regions surrounding the openings. These regions do not have structures. When the plates are subjected to pressure, these regions can become warped. The flat regions are subjected to the pressures of the media. These pressures normally differ for each medium. The difference in pressure also acts on the flat regions surrounding the openings. Because the base planes and the offset planes of adjacent plates bear on one another, these flat regions only come in contact with one of the two media. This advantageously means that the difference in pressure between the two media does not act thereon. The plates can be advantageously strengthened in this manner. The thickness of the plates can advantageously be maintained or even reduced. The strength refers to the mechanical load-bearing capacity of a plate. Breakage or permanent deformation of the plate can diminish this load-bearing capacity.

The at least two plates each have at least two domes. The at least two first domes on the at least one first plate extend upward in the stacking direction, and the at least two second domes on the at least one second plate extend downward in the stacking direction, such that the at least two domes each form the transition from the base planes to the offset planes. The transition from the base planes to the offset planes can form an edge or step. The base plane has at least two first openings, and the offset planes have at least two second openings. The offset planes on two adjacent plates can be joined to one another. This seals off the hollow chambers between adjacent planes from one another in a fluid-tight manner. Different flow paths for the two media through the heat exchanger according to the invention can be advantageously obtained by placing more than two first openings in the base plane, with or without domes, and placing more than two openings in the offset planes, with or without domes. This allows for a medium to be diverted into the offset planes in the plates, and/or in the stacking direction. A lot of heat must be dissipated quickly in a vehicle with an electric, or predominantly electric, drive. The capacity of the heat exchanger can be increased by enlarging the plates or increasing the volumetric flow of the media. By increasing the volumetric flow, pressure losses in the flow paths are also unfortunately increased. The pressure losses can be advantageously limited in relation to the volumetric flow through the various ways in which the media can be conducted through the heat exchanger according to the invention. The pressure loss is the difference in pressure resulting from friction in the lines or channels. Pressure losses increase exponentially in relation to the volumetric flow of a medium. Pressure losses correspond to energy losses. These energy losses must then be compensated for.

The at least two plates each have a circumferential rim that extends upward in the stacking direction. Adjacent plates can be joined together at the rims. This seals off the heat exchanger according to the invention from the environment in a fluid-tight manner. In a first embodiment of the heat exchanger according to the invention, the at least two domes can be spaced apart from the rim. The at least two plates can be rectangular or square. If they are square, the sides of the plates are basically the same length. Spacing the at least two domes apart from the rim advantageously ensures that one of the two media can flow through the entire hollow chamber between two adjacent plates. This advantageously prevents the formation of dead areas. A dead area is a region in a plate where a medium has no effect.

In a first embodiment according to the invention, the heat exchanger can have a longitudinal direction. The longitudinal direction can extend along the longer side of the heat exchanger. The heat exchanger can have two flow paths for the two media. The directions in which the two media flow between adjacent plates can be parallel and/or diagonal to the longitudinal direction. The plates can each have two first openings and two second openings. The first medium can be distributed over and removed from the plates through the first openings, and the second medium can be distributed over and removed from the plates through the second openings. The two media can enter and exit the hollow chambers formed between the plates.

In a second embodiment, the heat exchanger can have a longitudinal direction. The longitudinal direction can extend along the longer side of the heat exchanger. The heat exchanger can have two flow paths for the two media. The direction in which the first medium flows between two adjacent plates can be parallel and/or diagonal to the longitudinal direction. The second medium can flow through a hairpin curve in the stacking direction. A first plate and second plate can each have two first openings and three second openings. The first medium can be distributed over and removed from the plates through the two first openings. The second medium can be distributed over and removed from the plates through two of the three second openings. The second medium can be diverted through a U-shaped turn through the third of the second openings in the stacking direction. The third second opening can be larger than the other two. One of the two smaller second openings can have a domed rim. Consequently, two variants of the first and second plate can be obtained. Two adjacent plates can be joined together at the domed rims. Two adjacent hollow chambers for the second medium can be sealed off from one another in a fluid-tight manner. The first medium can enter and exit the hollow chambers formed between two adjacent plates. The second medium can enter a first hollow chamber at one of the two sides of the heat exchanger, and exit in a lower hollow chamber.

In a third embodiment of the heat exchanger according to the invention, the two media can each flow through U-shaped turns in the stacking direction. The heat exchanger can have two flow paths for the two media. The at least two plates can each have three first openings and two second openings. The first medium can be distributed over and removed from the plates through two of the first openings. The first medium can be diverted through a U-shaped turn in the stacking direction through the third, larger first opening. One of the two smaller first openings can have a domed rims. Consequently, two variants of the first plate can be obtained. The second medium can be distributed over and removed from the plates through two of the three second openings. The second medium can be diverted through a U-shaped turn in the stacking direction through the third, larger second opening. One of the two smaller second openings can have a domed rim. Consequently, two variants of the second plate can be obtained. Two adjacent plates can be joined together at the domed rims. As a result, adjacent hollow chambers for the two media can be sealed off from one another in a fluid-tight manner. The heat exchanger can contain four different plates. The two media can enter a first hollow chamber between two adjacent plates at one side of the heat exchanger, and exit in a lower hollow chamber.

In a fourth embodiment according to the invention, the first medium can be diverted through a U-shaped turn in the stacking direction. The second medium can flow through U-shaped turns parallel to the base plane. The heat exchanger can have two flow paths. The at least two plates can each have three first openings and at least four second openings. The first medium can be distributed over and removed from the plates through two of the three first openings. The first medium can be diverted through a U-shaped turn in the stacking direction through the third first opening. One of the two first openings can have a domed rim. Two adjacent hollow chambers for the first medium can therefore be sealed off from one another in a fluid-tight manner. The second medium can be distributed over and removed from the plates through the at least four second openings. The offset planes and the domes can form channels between two adjacent plates. The channels can form U-shaped turns on the base plane, such that the second medium can be diverted through U-shaped turns along the base plane. The first medium can be gaseous, for example. As a result of the shape of the channels, hollow chambers with an advantageously large flow cross section can be obtained for the first medium. The channels can have a nearly circular cross section. Carbon dioxide (R744) can be used for the second medium. Carbon dioxide can be more pressurized than other refrigerants such as R1234yf or propane (R245). The plates can be strengthened by the circular cross section. The first medium can enter the hollow chamber between two plates and exit at a lower hollow chamber on one side of the heat exchanger. The second medium can enter and exit the heat exchanger in the stacking direction at the other side of the heat exchanger. An adjacent plate can bear on the structures, thus strengthening the plates.

The at least two plates in the first four variants of the heat exchanger according to the invention can each have at least two first openings and at least two second openings. At least one of the at least two first openings in the at least one first plate can have a circumferential first domed rim. The first domed rim can extend either upward or downward in the stacking direction. At least one of the at least two second openings in the at least one second plate can have a circumferential second domed rim. The second domed rim can extend either upward or downward in the stacking direction. Two adjacent plates can be joined at the first domed rims, and two adjacent plates can be joined at the second domed rims. Consequently, two adjacent hollow chambers can be sealed off from one another in a fluid-tight manner, such that the different flow paths for the two media can be obtained in a simple manner. A heat exchanger according to the invention can have two variants of the two plates, resulting in a total of four different plates. One plate can be produced with domed rims at all of the openings in a first step, for example. In a second step, the unnecessary domed rims can be cut off. As a result, the two variants of the at least two plates that are needed can be produced in a simple manner.

In another embodiment of the heat exchanger according to the invention, the at least two plates can each have a rim that extends upward. This rim can border on sections of the offset planes. The plates can be rectangular. One side can be significantly longer than the other. The two media can flow along the longer side. As a result, no, or nearly no, dead areas for the two media are formed. Two adjacent plates can be joined to one another at the rims, and the hollow chambers formed between two adjacent plates can thus be sealed off from the environment in a fluid-tight manner.

In another exemplary embodiment of the heat exchanger according to the invention, the two media can flow between two adjacent plates in a direction parallel and/or diagonal to the longitudinal direction. The longitudinal direction of the plates can run along the longer side of heat exchanger. The at least two plate can each have two first openings and two second openings through which the two media can be distributed over and removed from the two plates. The two media can each enter and exit the hollow chambers between two adjacent plates in the stacking direction.

In another embodiment according to the invention, the heat exchanger can have a longitudinal direction and a lateral direction. The first structure in the at least one first plate can be offset to the second structure in the at least one second plate longitudinally and/or laterally. The structures can divide the hollow chambers between two adjacent plates into channels. By offsetting the first structure in relation to the second structure, blockage of the channels can be avoided. The plates can be rectangular. The longitudinal direction can run along the longer side, and the lateral direction can run along the shorter side.

In another embodiment of the heat exchanger according to the invention, the first structure in the at least one first plate can be rotated about the stacking direction in relation to the second structure in the at least one second plate. The structures can divide the hollow chambers between adjacent plates into channels. By rotating the first structure, blockage of the channels can be avoided.

In another embodiment according to the invention, the heat exchanger can have at least one third plate. The at least one third plate can have at least one channel. Regions of the heat exchanger that contain different flow paths for the two media can be connected by the at least one third plate. By way of example, a first part of the heat exchanger in the first embodiment according to the invention can be connected to a second part of the second embodiment according to the invention. The capacity of the heat exchanger can be increased in this manner, while limiting the pressure losses.

In another exemplary embodiment, the heat exchanger according to the invention can have at least four fourth plates, which can collectively form a supercooling path. The heat exchanger contains the at least four fourth plates in addition to the at least two plates. The heat exchanger can be used as a condenser, for example. The condensing medium can be further cooled in the supercooling path. This can advantageously increase the capacity of the refrigerant circuit, because a larger liquid portion of the medium is available for vaporization in the downstream vaporizer.

In another embodiment of the heat exchanger according to the invention, an interrupted domed rim can be placed around the at least two openings. An interrupted domed rim can be placed in this case on one of the openings that does not have a domed rim. This interrupted rim can also in the opposite direction of the offset plane and/or downward in the stacking direction, or in the opposite direction of a domed rim. An interrupted domed rim can extend upward or downward in the stacking direction. An adjacent plate can advantageously be supported on the interrupted domed rim. This increases the strength of the plates, or allows for the thickness of the plates to be reduced without decreasing the strength thereof. The flat regions around the openings are often the regions of the plates subjected to the greatest loads. By way of example, an interrupted domed rim can be produced by producing a domed rim around an opening during the stamping process, and then making cuts therein to create the interruptions.

In a first application, the heat exchanger can be used in a refrigerant circuit for a motor vehicle. It may be necessary to quickly discharge a great deal of heat in a motor vehicle with an electric, or predominantly electric, drive. Therefore, it may also be necessary to increase the volumetric flow of the media. This can lead to a pressure increase in the hollow chambers between the plates. The two media may be at different pressures. The greatest load to the plates is at the flat regions surrounding the openings in the plates. Because these regions only come in contact with one of the media, there is no load to the plates caused by a difference in pressures in these regions, and the plates are not weakened due to an increase in the volumetric flow. Furthermore, the capacity of the heat exchanger can be advantageously modified through the flexibility in designing the flow paths for the media.

In a second application according to the invention, the heat exchanger can be used in a coolant circuit for a motor vehicle. The coolant pressure losses in the heat exchanger have a substantial impact on the behavior of the coolant circuit. It may be necessary to quickly discharge a great deal of heat in a motor vehicle with an electric, or predominantly electric, drive. Therefore, it may also be necessary to increase the volumetric flow of the media, which can lead to an undesired increase in coolant pressure losses. The increase in pressure losses in the heat exchanger accompanying an increase in the volumetric flow can be advantageously limited by increasing the flexibility in the design of the flow paths for the media. This is because the flow cross section in the flow path for a medium can be readily altered. Undesired temperature changes or pressure changes in the medium (coolant) can thus be avoided by this means.

Figure 1A:
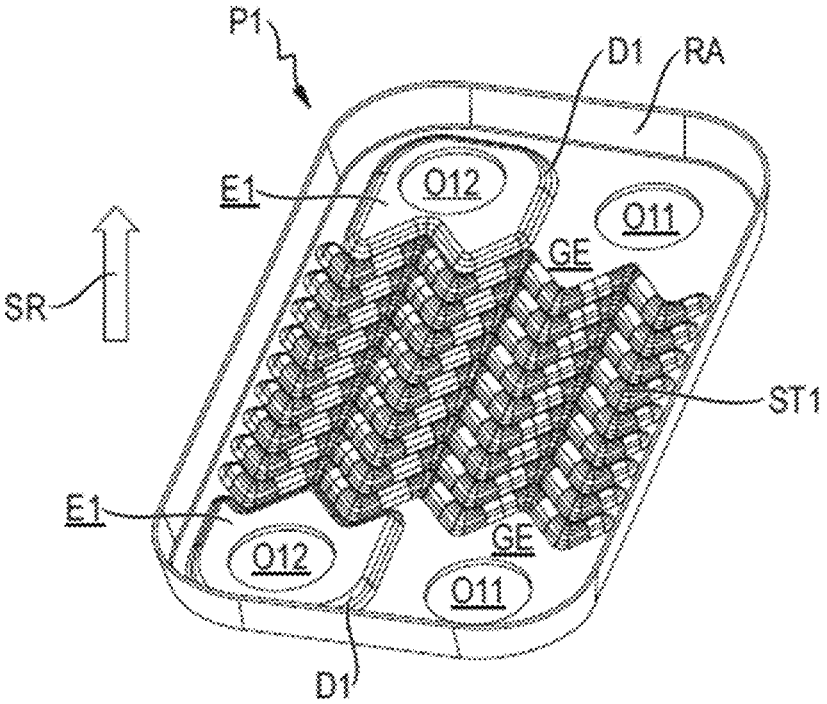
FIG. 1A shows a first plate (P1) in a first embodiment from above in a first embodiment according to the invention.
Figure 1B:
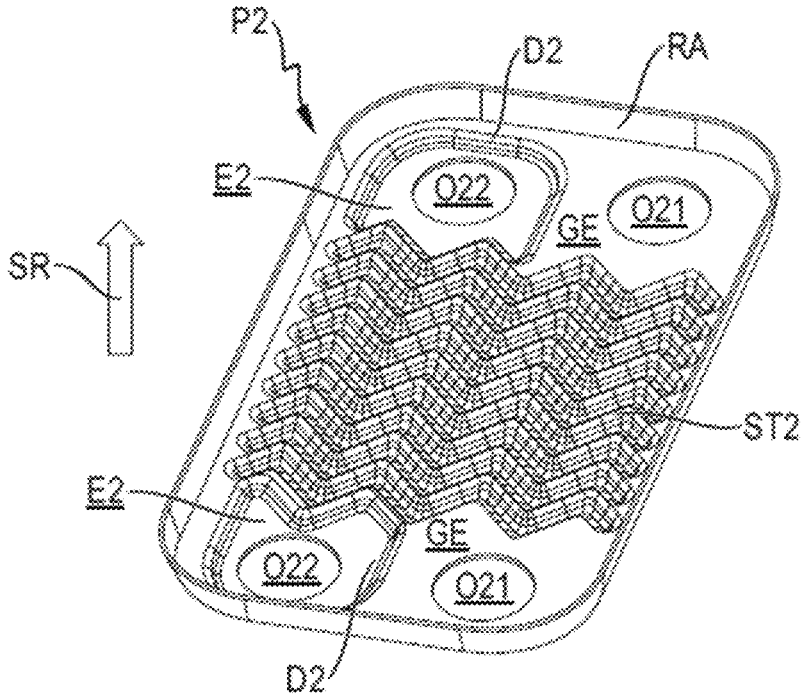
FIG. 1B shows a second plate (P2) from above in the first embodiment according to the invention.

Two plates P1, P2 in first embodiment according to the invention are shown in FIGS. 1A-1D. FIG. 1A shows the first plate P1, and FIG. 1B shows the second plate P2, both from above. The two plates P1, P2 each have a base plane GE. The stacking direction SR is perpendicular to the base plane GE. The raised circumferential rim RA on the plates P1, P2 extends upward in the stacking direction SR. The two plates P1, P2 each have structures S1, S2, formed by upward and downward corrugations. The surface area of the two plates P1, P2 available for heat exchange is increased in this manner. The two plates P1, P2 each have two first openings O11, O21 and two second openings O12, O22. A first medium (not shown) can be distributed over and removed from the plates P1, P2 through the two first openings O11, O21, and a second medium (not shown) can be distributed over and removed from the plates P1, P2 through the two second openings. The two plates P1, P2 each have planes E1, E2 that are offset and parallel to the base plane GE. Domes D1, D2 form the transitions from the base plane G3 to the offset planes E1, E2. These domes D1, D2 are in the form of steps. The offset planes E1, E2, and therefore the domes D1, D2, are spaced apart from the rim. The two second openings O12, O22 are located in the offset planes E1, E2, and the two first openings O11, O21 are located in the base plane GE. The two plates P1, P2 have a longer side and a shorter side. The longer side forms the lateral direction (not indicated) of the plates P1, P2. The two media (not shown) flow parallel to the longer side, and therefore also to the lateral direction (not indicated). Because the domes D1, D2 are spaced apart from the rim, the entire surface of the plates P1, P2 comes in contact with the media (not shown). This advantageously means that there are no surfaces that do not participate in heat exchange. The two plates P1, P2 can contain a metal. The two plates P1, P2 can be made of an aluminum alloy. The two plates P1, P2 could also be made of stainless steel. The plates P1, P2 are made of a single piece, and can be produced with a stamping process. The two plates P1, P2 could also be produced with a deep drawing process.

FIG. 1A shows a first plate P1 from above in a first embodiment according to the invention. The first structure S1 rises upward in the stacking direction SR and the first offset plane E1 is raised upward in the stacking direction SR, parallel to the base plane GE. FIG. 1B shows a second plate P2 from above in a first embodiment according to the invention. The second structure S2 is recessed downward in the stacking direction SR, and the second offset plane E2 is recessed downward in the stacking direction SR, parallel to the base plane GE. When a heat exchanger is assembled by stacking numerous plates P1, P2 in the stacking direction SR, hollow chambers comprising channels are formed between the plates P1, P2. These hollow chambers are sealed off from one another in a fluid-tight manner, and the two media (not shown) flow through them in an alternating sequence. The base planes GE and the offset planes E1, E2 bear against one another in the stack. The two media (not shown) may be at different pressures. The base planes come in contact with the first medium, and the offset planes E1, E2 come in contact with the second medium. This prevents loads to the flat regions of the plates P1, P2 caused by pressure differences, thus increasing the strength of the plates P1, P2. The first structure S1 is rotated 180° about the stacking direction SR in relation to the second structure S2. This prevents blockage of the channels (not shown) between the structures S1, S2. The two media enter and exit the hollow chambers between adjacent plates P1, P2 in the stacking direction.

Figure 2A:
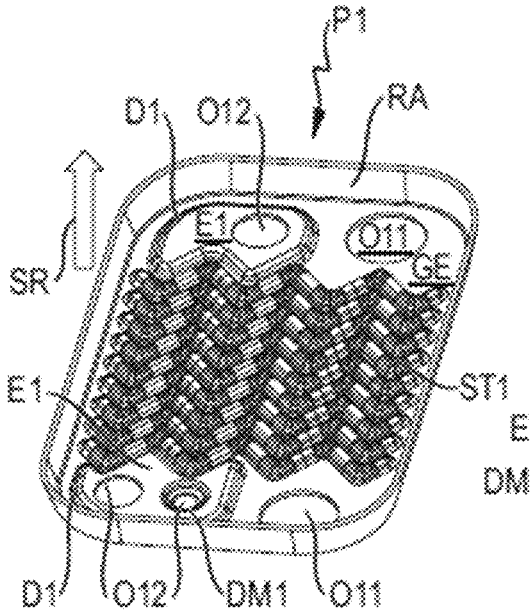
FIG. 2A shows a first plate (P1) from above in a second embodiment according to the invention.
Figure 2C:
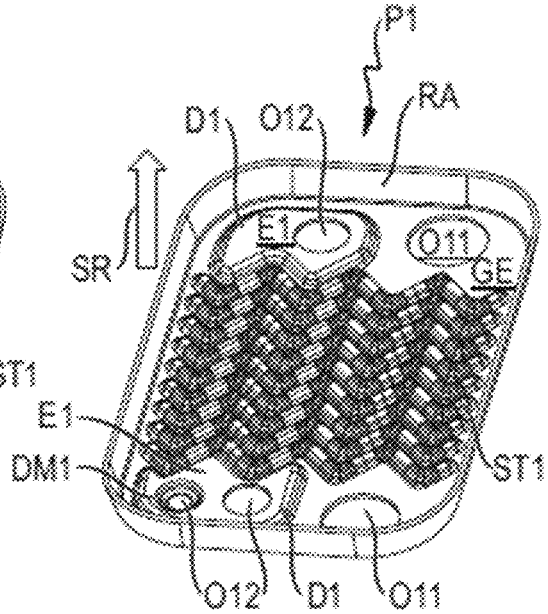
FIG. 2C shows another view of the first plate (P1) from above in the second embodiment according to the invention.

FIGS. 2A-2D show the plates P1, P2 in a second embodiment according to the invention. FIGS. 2A and 2C each show a first plate P1 from above, and FIGS. 2B and 2D each show a second plate P2 from above. The two plates P1, P2 each have a base plane GE. The stacking direction SR is perpendicular to the base plane GE. The raised circumferential rim RA on the plates P1, P2 extends upward in the stacking direction SR. The plates P1, P2 each have structures S1, S2, which are formed by upward and downward corrugations. The surface area of the two plates P1, P2 available for heat exchange is increased in this manner. The two plates P1, P2 each have two first openings O11, O21 and three second openings O12, O22. The two plates P1, P2 each have planes E1, E2 that are offset and parallel to the base plane GE. Domes D1, D2 form the transitions from the base plane G3 to the offset planes E1, E2. These domes D1, D2 are in the form of steps. The domes D1, D2, and therefore the offset planes E1, E2, are spaced apart from the rim RA. The two plates P1, P2 have a longer side and a shorter side. The longer side forms the lateral direction (not indicated) of the plates P1, P2. A first medium (not shown) is distributed over and removed from the plates P1, P2 through the two first openings O11, O21. The first medium (not shown) flows parallel to the longer side, and therefore parallel to the lateral direction (not indicated). Because the domes D1, D2 are spaced apart from the rim, the entire surface of the plates P1, P2 comes in contact with the media (not shown). This advantageously means that there are no surfaces that do not participate in heat exchange. The two first openings O11, O12 are each in the base plane GE, and the three second openings O12, O22 are in the offset planes E1, E2. Two of the three second openings O12, O22 are smaller than the third second opening O12, O22, and placed along the shorter side, while the third, larger, second opening O12, O22 is on the opposite side. A second medium (not shown) is diverted through a U-shaped turn in the stacking direction SR via the third, larger, second opening O12, O22. The second medium (not shown) is distributed over and removed from the plates P1, P2 through the two smaller second openings O12, O22. The hollow chambers (not shown) through which the second medium flows, are sealed off from one another in a fluid-tight manner by domed first rims DO1 on at least one of the first openings O11, O21, and by domed second rims DO2 on at least one of the second openings O21, O22. The two plates P1, P2 can contain a metal. The two plates P1, P2 can be made of an aluminum alloy. The two plates P1, P2 could also be made of stainless steel. The plates P1, P2 are made of a single piece, and can be produced with a stamping process. The two plates P1, P2 could also be produced with a deep drawing process.

Figure 2B:
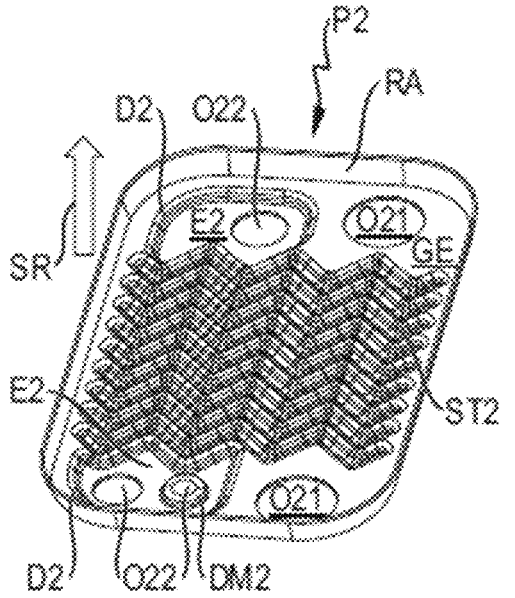
FIG. 2B shows a second plate (P2) from above in the second embodiment according to the invention.
Figure 2D:
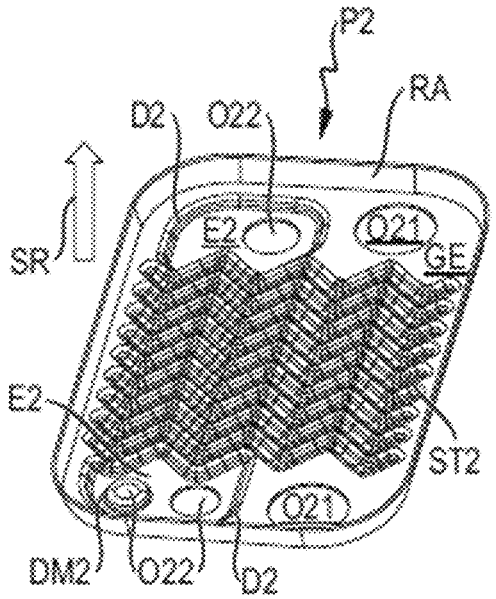
FIG. 2D shows another view of the second plate (P2) from above in the second embodiment of the invention.

FIGS. 2A and 2C each show a first plate P1 from above in a second embodiment according to the invention. The first structure S1 rises upward in the stacking direction SR, and first offset plane E1 is raised upward in the stacking direction, and is parallel to the base plane GE. FIGS. 2B and 2D each show a second plate P2 from above in a second embodiment according to the invention. The second structure S2 extends downward, counter the stacking direction SR, and the second offset plane E2 is recessed downward, counter to the stacking direction SR, and is parallel to the base plane GE. The left-hand second opening O12 in FIG. 2A has a downward-facing first domed rim DM1, and the left-hand second opening O22 in FIG. 2B has a raised, domed rim, extending upward in the stacking direction SR. The left-hand second opening O12 in FIG. 2B has a downward-facing first domed rim DM1, and the left-hand second opening O22 in FIG. 2D has second domed rim DM2 that extends upward in the stacking direction SR. When a first plate P1 and second plate P2 are stacked, the first domed rim DM1 and second domed rim DM2 come in contact with one another. The plates can be produced with domed rims DM1, DM2 on both of the smaller second openings. The unnecessary domed rims DM1, DM2 can then be cut off to obtain the two variants of the plates P1, P2.

Plates P1, P2 are shown in FIGS. 3A-3D in another embodiment according to the invention. A first plate P1 is shown from above in FIG. 3A and FIG. 3C, and a second plate P2 is shown from above in FIG. 3B and FIG. 3D. The two plates P1, P2 each have a base plane GE. The stacking direction SR is perpendicular to the base plane GE. The raised circumferential rim RA on the plates P1, P2 extends upward in the stacking direction SR. The plates P1, P2 each have structures S1, S2, which are formed by upward and downward corrugations. The surface area of the two plates P1, P2 available for heat exchange is increased in this manner. The two plates P1, P2 each have three first openings O11, O21 and three second openings O12, O22. The two plates P1, P2 each have planes E1, E2 that are offset and parallel to the base plane GE. Domes D1, D2 form the transitions from the base plane G3 to the offset planes E1, E2. These domes D1, D2 are in the form of steps. The domes D1, D2, and therefore the offset planes E1, E2, are spaced apart from the rim RA. The two plates P1, P2 have a longer side and a shorter side. Because the domes D1, D2 are spaced apart from the rim, the entire surface of the plates P1, P2 comes in contact with the media (not shown). This advantageously means that there are no surfaces that do not participate in heat exchange. The three first openings O11, O12 are each in the base plane GE, and the three second openings O12, O22 are in the offset planes E1, E2. One of the three second openings O12, O22 is located between two first openings O11,O21 along one of the shorter sides of the plates P1, P2. The third first opening O11, O21 is between two second openings on the opposite short side. A first medium (not shown) is distributed onto and removed from the plates P1, P2 through the two first openings O11, O21 on the one short side. The first medium is then diverted through a U-shaped turn in the stacking direction SR through the third first openings O11, O21 on the opposite side. A second medium (not shown) is distributed over the plates P1, P2 through the two second openings O12, O22, and diverted through a U-shaped turn in the stacking direction SR by the third second opening O12, O22 on the opposite side. The two media each enter the hollow chambers (not shown) between two adjacent plates P1, P2 in the stacking direction SR on one side of the heat exchanger (not shown). These hollow chambers are sealed off from one another in a fluid-tight manner by domed first rims DO1 on at least one of the first openings O11, O21, and by domed second rims DO2 on at least one of the second openings O21, O22. The second structure S2 is rotated 180° about the stacking direction SR in relation to the first structure S1. The prevents blockage of the channels formed between the structures S1, S2. The two plates P1, P2 can contain a metal. The two plates P1, P2 can be made of an aluminum alloy. The two plates P1, P2 could also be made of stainless steel. The plates P1, P2 are made of a single piece, and can be produced with a stamping process. The two plates P1, P2 could also be produced with a deep drawing process.

Figure 3A:
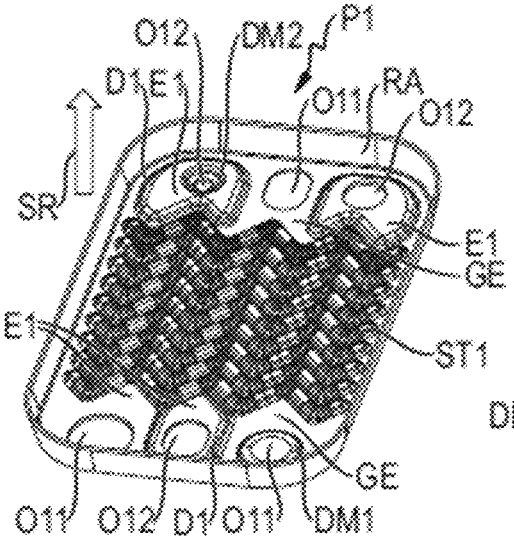
FIG. 3A shows a first plate (P1) from above in accordance with a third embodiment according to the invention.
Figure 3C:
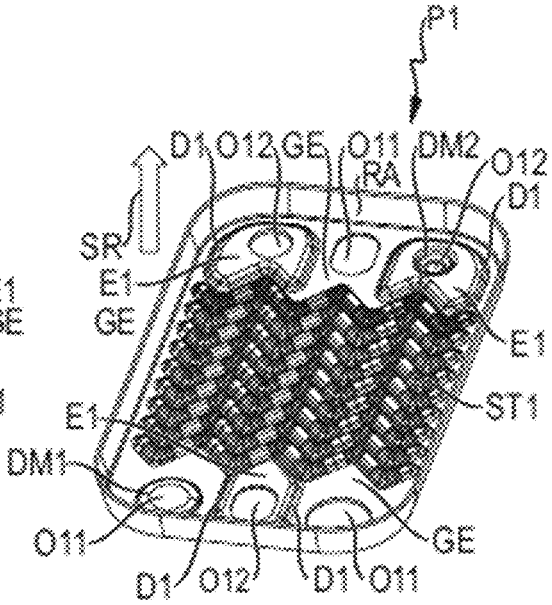
FIG. 3C shows another view of the first plate (P1) from above in the third embodiment.
Figure 3B:
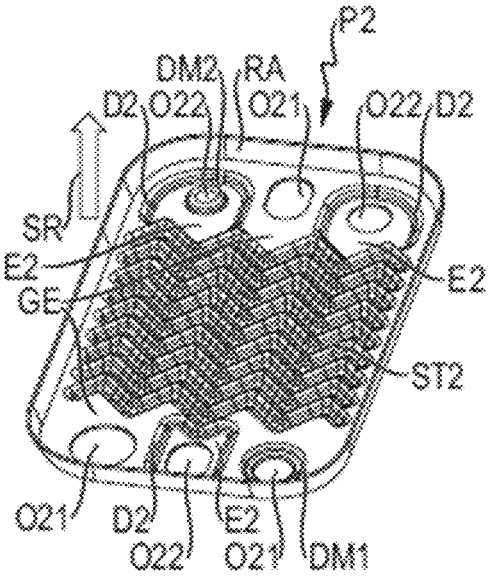
FIG. 3B shows a second plate (P2) from above in the embodiment of FIG. 3A.
Figure 3D:
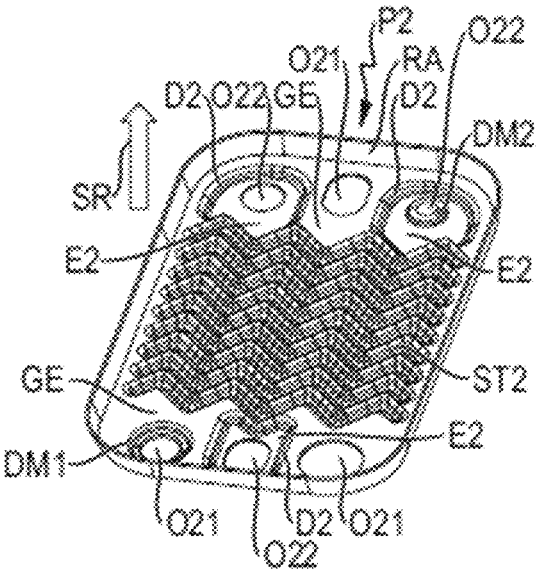
FIG. 3D shows another view of the second plate (P2) from above in the third embodiment.

FIGS. 3A and 3C each show a first plate P1 from above in first embodiment according to the invention. The first structure S1 extends upward in the stacking direction SR, and the first offset plane E1 is raised upward in the stacking direction, and is parallel to the base plane GE. FIGS. 3B and 3D show a second plate P2 from above in a first embodiment according to the invention. The second structure S2 extends downward in the stacking direction SR, and the second offset plane E2 is recessed downward in the stacking direction SR, and is parallel to the base plane GE. The right-hand, lower first opening O11 in FIG. 3A has a first domed rim DM1 that rises upward in the stacking direction SR. The left-hand, upper second opening O12 has a second domed rim DM2 that extends downward in the stacking direction SR. The left-hand, lower first opening O11 in FIG. 3B has a first domed rim DM1 that rises upward in the stacking direction SR. The upper, right-hand second opening O12 has a second domed rim DM2 that extends downward in the stacking direction SR. The left-hand, lower first opening O21 in FIG. 3B has a first domed rim DM2 that extends downward in the stacking direction SR, and the right-hand, upper, second opening O22 has a second domed rim DM2 that rises upward in the stacking direction SR. The left-hand, lower first opening O21 in FIG. 3D has a first domed rim DM1 that extends downward in the stacking direction SR, and the right-hand, upper second opening O22 has a second domed rim DM2 that rises upward in the stacking direction SR. The plates P1, P2 can be produced with a stamping process, such that the outer first openings O11, O21 each have a first domed rim DM1 and the outer second openings O12, O22 each have a second domed rim DM2. When a first plate P1 and a second plate P2 are stacked, the first domed rim DM1 and second domed rim DM2 come in contact with one another. The plates P1, P2 can be produced such that the two smaller second openings each have a domed rim DM1, DM2. The unnecessary domed rims DM1, DM2 can then be cut off, such that the two variants of the plates P1, P2 are obtained.

Figure 4A:
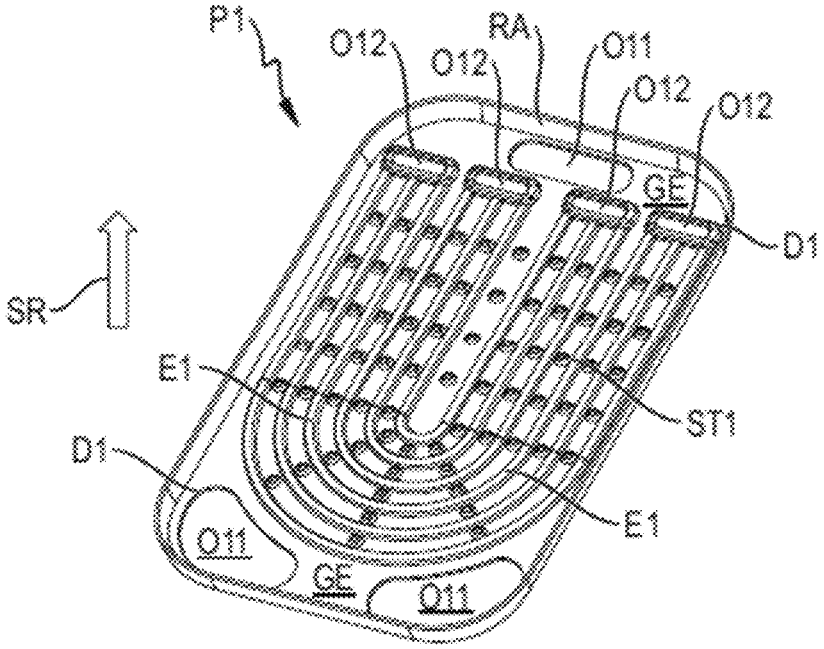
FIG. 4A shows a first plate (P1) from above in a fourth embodiment of the invention.
Figure 4B:
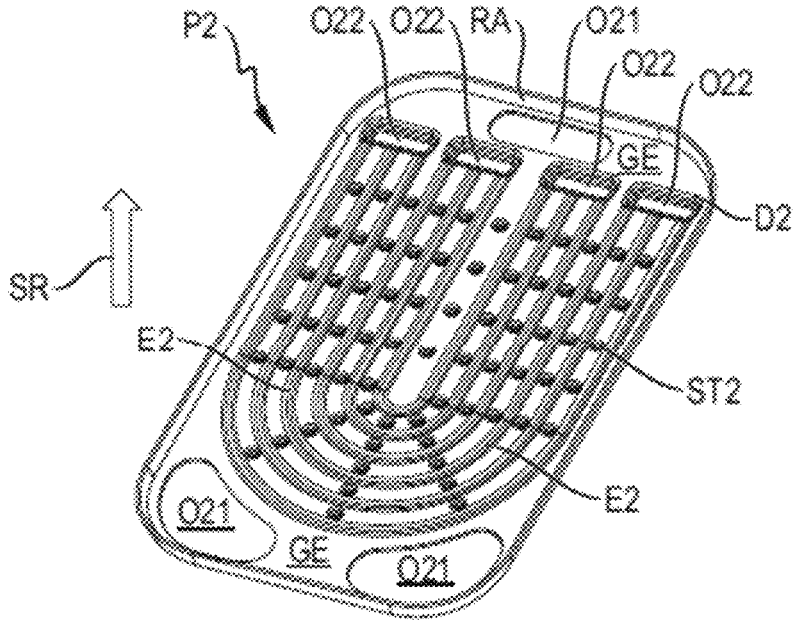
FIG. 4B shows a second plate (P2) from above in the fourth embodiment of the invention.

Two plates P1, P2 are shown in FIGS. 4A-4B in another embodiment according to the invention. FIG. 4A shows a first plate P1 from above, and FIG. 4B shows a second plate P2 from above. The two plates P1, P2 each have a base plane GE. The stacking direction SR is perpendicular to the base plane GE. The raised circumferential rim RA on the plates P1, P2 extends upward in the stacking direction SR. The plates P1, P2 each have structures S1, S2 formed by raised bumps. Adjacent plates (not shown) can rest on these structures S1, S2, thus strengthening plates P1, P2. Each of the plates P1, P2 has three first openings O11, O21 and four second openings O12, O22. The two plates P1, P2 each have offset planes E1, E2 that are parallel to the base plane GE. These offset planes E1, E2 form ridges and grooves on the base plane GE. The transition from the base plane GE to the offset planes E1, E2 is formed by domes D1, D2. The domes D1, D2 form circumferential rims surrounding the four openings O21, O22, and each of the domes D1, D2 is spaced apart from the rim RA, such that the offset planes E1, E1 are also spaced apart from the rim RA. This eliminates any dead areas on the surfaces of the plates P1, P2. The two plates P1, P2 each have a longer side and shorter side. The two plates P1, P2 can contain a metal. The two plates P1, P2 can be made of an aluminum alloy. The two plates P1, P2 could also be made of stainless steel. The plates P1, P2 are made of a single piece, and can be produced with a stamping process. The two plates P1, P2 could also be produced with a deep drawing process. A first medium (not shown) can be diverted through a U-shaped turn in the stacking direction in the heat exchanger (not shown) through the third first opening O11, O22. The two first openings O11, O21 on the other side can each have a domed rim (not shown). This seals off hollow chambers (not shown) between adjacent plates P1, P2 in a fluid-tight manner. The first medium (not shown) enters and exits the hollow chambers (not shown) between two adjacent plates P1, P2 in the stacking direction SR on one side of the heat exchanger (not shown). When a first plate P1 and a second plate P2 are stacked on top of one another, the base planes GE and the offset planes E1, E2 bear against one another. The offset planes E1, E2 with their grooves and ridges in the plates P1, P2 form U-shaped channels that are parallel to the base plane GE. A second medium (not shown) is diverted in U-shaped turns over the base plane in this manner. The second medium enters and exits on one side of the heat exchanger (not shown) along the stacking direction SR. The second medium can be more pressurized than the first medium. The strength of the plates P1, P2 can be advantageously accommodate the higher pressure of the second medium as a result of the round cross section of the channels. The first medium can be a gas. The hollow chamber (not shown) between two adjacent plates P1, P2 has a large cross section in order to advantageously limit any pressure losses. A first plate P1 is shown in FIG. 4A from above in another embodiment according to the invention. The first plate P1 has ridges that rise upward in the stacking direction SR. The upper flat part of these ridges forms the first offset plane E1, which is parallel to the base plane GE. The ridges follow a U-shaped path parallel to the base plane GE of the first plate P1, and terminate in the first domes D1. The four second openings O12 are each encompassed by the first domes D1. The first structures S1 are raised in the stacking direction SR.

FIG. 4B shows a second plate P2 from above in another embodiment according to the invention. The second plate P2 has recessed grooves, counter to the stacking direction SR. The lower flat part of the recessed grooves forms the second offset plane E2, which is parallel to the base plane GE. The recessed grooves follow U-shaped paths parallel to the base plane GE, and terminate in the second domes D2. The four second openings O22 are encompassed by the second domes D2.

Figure 5A:
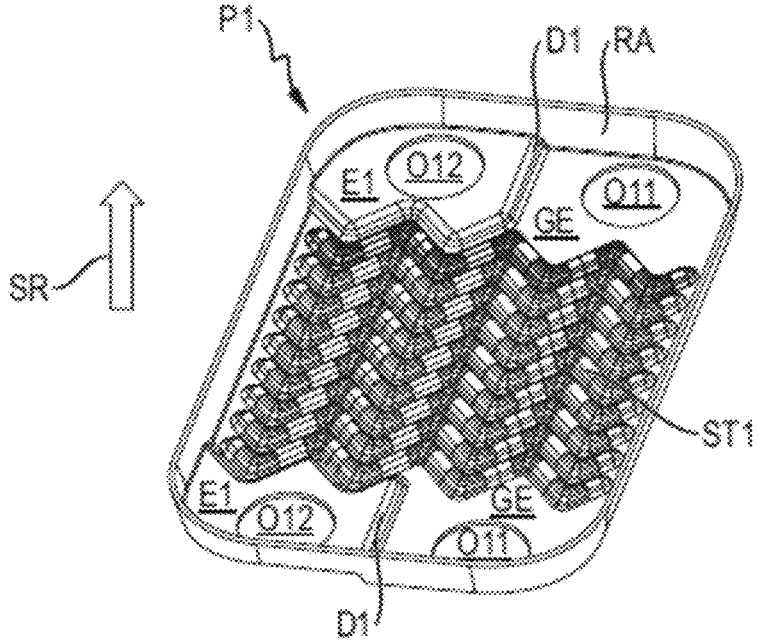
FIG. 5A shows a first plate (P1) from above in a fifth embodiment according to the invention.
Figure 5B:
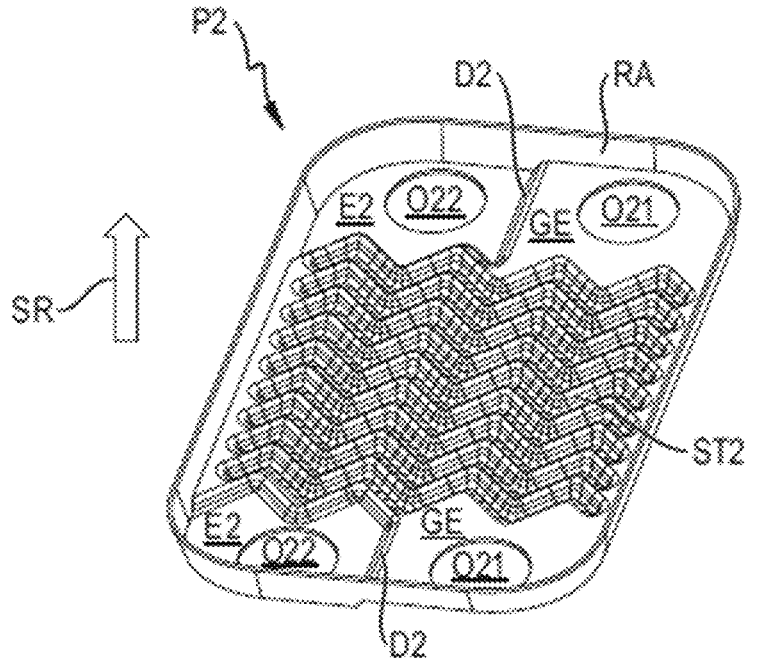
FIG. 5B shows a second plate (P2) from above in the fifth embodiment according to the invention.

Two plates P1, P2 are shown in FIGS. 5A-5B in another exemplary embodiment. A first plate P1 is shown from above in FIG. 5A, and a second plate is shown from above in FIG. 5B. The two plates P1, P2 each have a base plane. The stacking direction SR is perpendicular to the base plane GE. The raised circumferential rim RA on the plates P1, P2 extends upward in the stacking direction SR and the two plates P1, P2 each have structures S1, S2, which are formed by upward and downward corrugations. The plates P1, P2 are rectangular. The surface area of the two plates P1, P2 available for heat exchange is enlarged in this manner. The first structure S1 is rotated 180° about the stacking direction SR in relation to the second structure. This prevents blockage of the channels (not shown) formed between two adjacent plates P1, P2. The plates P1, P2 each have two first openings O11, O21 and two second openings O12, O22. The two plates P1, P2 each have planes E1, E2 that are offset and parallel to the base plane GE. The offset planes E1, E2 are delimited by the circumferential rim RA. The transitions from the base plane GE to the offset planes E1, E2 are formed by a dome D1, D2 in each case. The domes D1, D2 form steps. The two first openings O11, O21 are in the base plane GE and the two second openings O12, O22 are in the offset planes E1, E2. When the plates P1 and P2 are stacked, the base planes GE and offset planes E1, E2 bear against one another. The base plane GE has flat regions around the first openings O12, O21, and the offset planes E1, E2 have flat regions around the second openings O12, O22. These flat regions only come in contact with one of the two media (not shown). This advantageously prevents any loads to these flat regions resulting from the pressure differences between the two media. This advantageously strengthens the plates P1, P2. The two media enter and exit hollow chambers formed between two adjacent plates P1, P2 through the openings O11, O21, O12, O22. These hollow chambers (not shown) are formed between two adjacent plates P1, P2 and can be sealed off from one another in a fluid-tight manner by domed rims (not shown) on the openings O11, O21, O12, O22. The two media flow parallel to the longer sides of the plates P1, P2. The two plates P1, P2 can contain a metal. The two plates P1, P2 can be made of an aluminum alloy. The two plates P1, P2 could also be made of stainless steel. The plates P1, P2 are made of a single piece, and can be produced with a stamping process. The two plates P1, P2 could also be produced with a deep drawing process.

Another exemplary embodiment of the first plate P1 is shown from above in FIG. 5A. The first offset plane E1 is raised and parallel to the base plane GE. The first structure rises upward in the stacking direction SR.

Another exemplary embodiment of the second plate P1 is shown from above in FIG. 5B. The second plane E2 is recessed and parallel to the base plane GE. The second structure is recessed in the stacking direction SR.

Figure 6A:
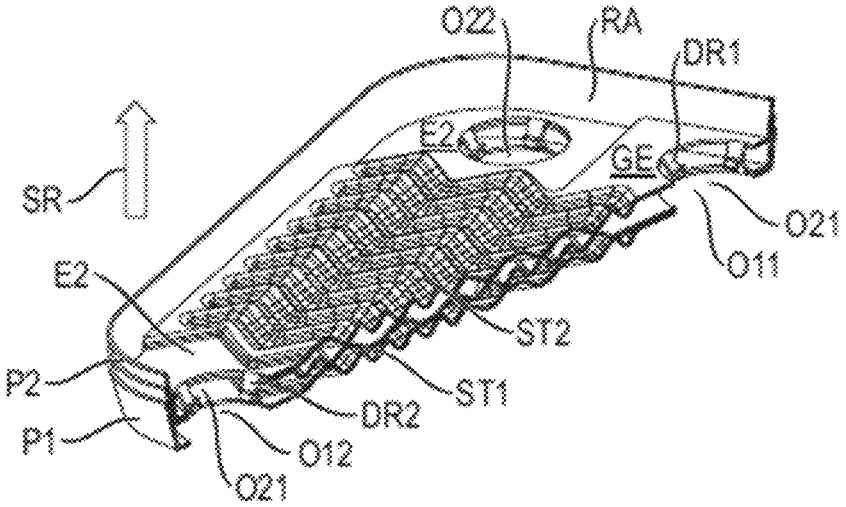
FIG. 6A shows a partial cutaway view of two stacked plates in cutaway view in a sixth embodiment according to the invention.
Figure 6B:
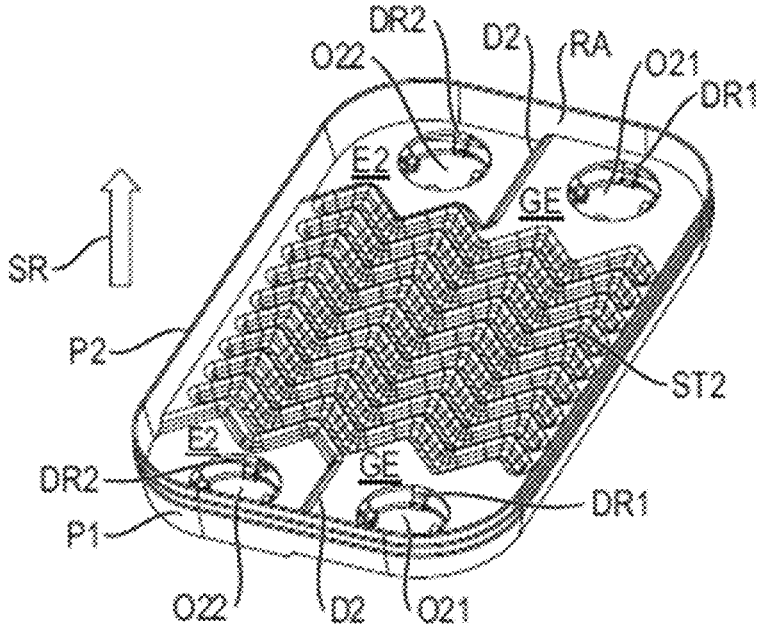
FIG. 6B shows a full view of the two stacked plates of FIG. 6A.

FIGS. 6A-6B show two plates P1, P2 stacked on one another in the stacking direction SR from above in another embodiment according to the invention. FIG. 6A shows a cutaway view of the plates P1, P2 from above, and FIG. 6B shows the stacked plates P1, P2 in their entirety from above. The second plate P2 is placed above the first plate P1 in the stacking direction SR. The stacking direction SR runs from the bottom to the top. The two plates P1, P2 are joined using a material-bonding process, e.g. brazing. Structures S1, S2 are formed on each of the plates. The first structure S1 rises upward in the stacking direction SR, and the second structure S2 extends downward in the stacking direction SR. The plates are joined at the structures S1, S2. The bond is formed by a material-bonding process such as brazing. The plates P1, P2 have a circumferential rim RA that extends upward in the stacking direction SR. The plates P1, P2 each have two first openings O11, O21 and two second openings O12, O22. The plates P1, P2 also have a base plane GE. The first plate P1 has an offset plane E1 that is raised above and parallel to the base plane GE in the stacking direction SR, and the second plate has a second offset plane E2 that is recessed and parallel to the base plane GE in the stacking direction SR. The base plane GE and the offset planes E1, E2 in the plates P1, P2 bear on one another and are joined to one another. A medium (not shown) flows through the hollow chamber formed between the plates P1, P2. A first interrupted rim DR1 is formed around each of the first openings O11, O21, and a second interrupted, domed rim DR2 is formed around each of the second openings. The domed, interrupted rims DR1, DR2 are each composed of a domed rim with four interruptions, and extend downward in the stacking direction SR. The second plate P2 is supported on the first plate P1 on the domed, interrupted rims DR1, DR2. The flat regions surrounding the four openings O11, O12, O22, O22 in the plates P1, P2 are subjected to the pressure of a medium (not shown). The plates P1, P2 can be advantageously strengthened by supporting the second plate P2 on the first plate P2. By way of example, the plates can be produced in a stamping process. The interrupted, domed rims DR1, DR2 can be produced in the stamping process for the plates P1, P2 as continuous rims, and the interruptions can be subsequently cut out. The plates P1, P2 can be made of an aluminum alloy, for example.

Figure 7:
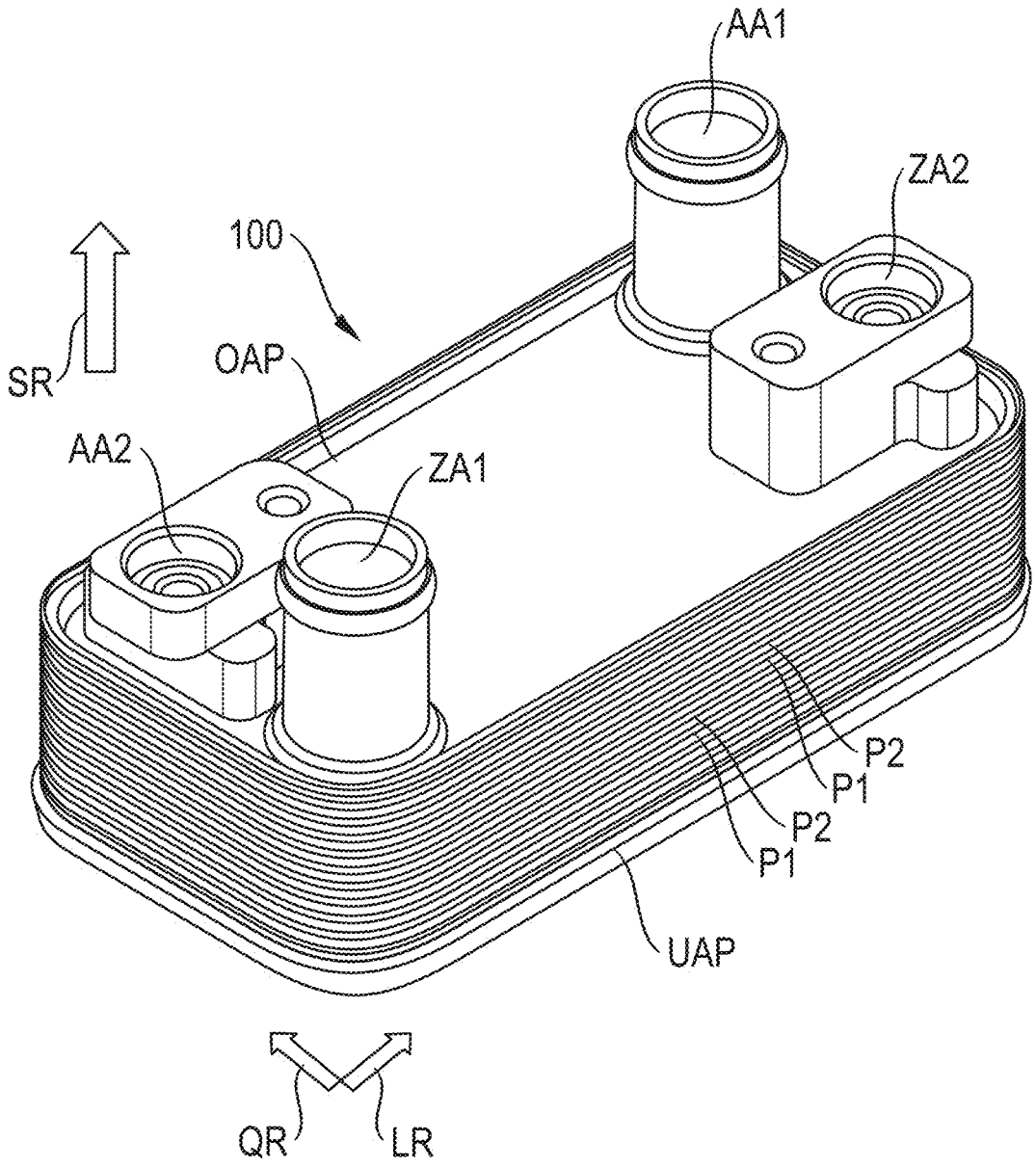
FIG. 7 shows the first embodiment of the heat exchanger according to the invention.

The first embodiment according to the invention of the heat exchanger 100 is shown in FIG. 7. The plates P1, P2 are stacked in the stacking direction SR between a lower cover plate UAP and an upper cover plate OAP. The plates P1, P2, upper cover plate OAP and lower cover plate UAP are joined in a material-bonding process, e.g. brazing. The plates P1, P2 are stacked in an alternating sequence. This results in two separate flow paths for two media (not shown). The upper cover plate ODP has a first intake port ZA1 and a first outlet port AA1 for a first medium (not shown). The upper cover plate ODP also has a second intake port ZA2 and a second outlet port AA2 for a second medium (not shown). The longitudinal direction LR of the heat exchanger 100 runs along the longer side, and the lateral direction QR runs along the shorter side. The media flow at a diagonal to the longitudinal direction LR.

The specification can be readily understood with reference to the following Numbered Paragraphs:

Numbered Paragraph 1. A heat exchanger (100), preferably for a motor vehicle, with:

a stacking direction (SR), at least one first plate (P1), at least one second plate (P2), wherein the at least two plates (P1, P2) are adjacent to one another or on top of one another in the stacking direction (SR), characterized in that the at least two plates (P1, P2) each have a base plane (GE), wherein the at least two plates (P1, P2) each have a plane (E1, E2) offset and parallel to the base plane (GE), wherein the first offset plane (E1) is raised above the first plate (P2) in the stacking direction (SR), wherein the second offset plane (E2) is recessed in the stacking direction (SR).

Numbered Paragraph 2. The heat exchanger (100) according to Numbered Paragraph 1, characterized in that the base plane (GE) has at least two first openings (O11, O21) through which a first medium (M1) passes, wherein the offset planes (E1, E2) each have at least two second openings (O12, O22) through which a second medium (M2) passes.

Numbered Paragraph 3. The heat exchanger (100) according to Numbered Paragraphs 1 and 2, characterized in that the at least two plates (P1, P2) each have a structure (ST1, ST2), wherein the first structure (ST1) rises above the first plate (P1) in the stacking direction (SR), wherein the second structure (ST2) is recessed in the second plate (P2) in the stacking direction.

Numbered Paragraph 4. The heat exchanger (100) according to Numbered Paragraphs 1, 2, 3, characterized in that the first plate (P1) and second plate (P2) are stacked in an alternating sequence in the stacking direction (SR), such that the base planes (GE) and the offset planes (E1, E2) of the at least two plates (P1, P2) bear on one another and are joined to one another.

Numbered Paragraph 5. The heat exchanger (100) according to any of the preceding Numbered Paragraphs, characterized in that the at least two plates (P1, P2) each have at least two domes (D1, D2), wherein the at least two first domes (D1) on the at least one first plate (P1) extend upward in the stacking direction (SR), and the at least two second domes (D2) on the at least one second plate (P2) extend downward in the stacking direction (SR), such that the at least two domes (D1, D2) form the transitions from the base plane (GE) to the offset planes (E1, E2).

Numbered Paragraph 6. The heat exchanger (100) according to Numbered Paragraph 5, characterized in that the at least two plates (P1, P2) each have a circumferential rim (RA) extending upward in the stacking direction (SR), wherein the at least two domes (D1, D2) are spaced apart from the rim (RA).

Numbered Paragraph 7. The heat exchanger (100) according to Numbered Paragraphs 2 to 6, characterized in that the heat exchanger (100) has a longitudinal direction (LR), wherein the two media (M1, M2) flow between two adjacent plates (P1, P2) parallel and/or diagonally to the longitudinal direction (LR).

Numbered Paragraph 8. The heat exchanger (100) according to Numbered Paragraphs 2 to 6, characterized in that the heat exchanger (100) has a longitudinal direction (LR), wherein the first medium (M1) flows between two adjacent plates (P1, P2) parallel and/or diagonally to the longitudinal direction (LR), wherein the second medium (M2) is diverted through a U-shaped turn in the stacking direction (SR).

Numbered Paragraph 9. The heat exchanger (100) according to Numbered Paragraphs 2 to 6, characterized in that the two media (M1, M2) are each diverted through a U-shaped turn in the stacking direction (SR).

Numbered Paragraph 10. The heat exchanger (100) according to Numbered Paragraphs 2 to 6, characterized in that the first medium (M1) is diverted through a U-shaped turn in the stacking direction (SR), wherein the second medium (M2) is diverted through a U-shaped turn parallel to the base plane (GE).

Numbered Paragraph 11. The heat exchanger (100) according to Numbered Paragraphs 8, 9, and 10, characterized in that at least one of the at least two first openings (O11, O21) in the at least one first plate (P1) has a circumferential first domed rim (DM1), wherein the first domed rim (DM1) extends upward or downward in the stacking direction (SR), wherein one of the at least two second openings (O21, O22) on the at least one second plate (P2) has a circumferential second domed rim (DM2), wherein the second domed rim (DM2) extends upward or downward in the stacking direction (SR).

Numbered Paragraph 12. The heat exchanger (100) according to Numbered Paragraphs 3 to 11, characterized in that the heat exchanger (100) has a longitudinal direction (LR) and a lateral direction (QR), wherein the first structure (S1) in the at least one first plate (P1) is offset longitudinally (LR) and/or laterally (QR) to the second structure (S2) in the at least one second plate (P2).

Numbered Paragraph 13. The heat exchanger (100) according to Numbered Paragraphs 3 to 11, characterized in that the first structure (S1) in the at least one first plate (P1) is rotated 180° about the stacking direction (SR) in relation to the second structure (S2) in the at least one second plate (P2).

Numbered Paragraph 14. The heat exchanger (100) according to Numbered Paragraphs 2 to 13, characterized in that there is an interrupted, domed rim (DR1, DR2) surrounding each of the at least two openings (O11, O12, O21, O22).

Numbered Paragraph 15. A heat exchanger (100) for a refrigerant circuit or a coolant circuit in a motor vehicle according to at least one of the preceding Numbered Paragraphs 1 to 14.

LIST OF REFERENCE SYMBOLS

100 heat exchanger according to the invention
P1 first plate according to the invention
P2 second plate according to the invention
P3 third plate according to the invention
P4 fourth plate according to the invention
RA circumferential raised rim
ST1 first structure on the first plate according to the invention
ST2 second structure on the second plate according to the invention
E1 first offset plane on the first plate according to the invention
E2 second offset plane on the second plate according to the invention
D1 first dome on a first plate according to the invention
D2 second dome on a first plate according to the invention
O11, O21 first openings for a first medium
O21, O22 second openings for a second medium
M1, M2 media flowing through the heat exchanger according to the invention
SR stacking direction of the heat exchanger according to the invention SR
LR longitudinal direction of the heat exchanger according to the invention
QR lateral direction of the heat exchanger according to the invention
DM1, DM2 domed rims on a first opening and second opening
DR1, DR2 interrupted domed rims on a first opening and second opening
ZA1, ZA2 intake port for a medium
AA1, AA2 outlet port for a medium
OAP upper cover plate for the heat exchanger according to the invention
UAP lower cover plate for the heat exchanger according to the invention

The invention claimed is:

1. A heat exchanger, for a motor vehicle, comprising:
a stacking direction,
at least one first plate,
at least one second plate,
wherein the at least one first plate and the at least one second plate comprise a raised circumferential lip about the periphery of the at least one first plate and the at least one second plate,
wherein the raised circumferential lip about the periphery of at the least one first plate and the at least one second plate is configured to provide a seal between the at least one first plate and the at least one second plate,
wherein the at least one first plate and the at least one second plate are adjacent to one another or on top of one another in the stacking direction,
wherein the at least one first plate and the at least one second plate each have a base plane, wherein the at least two plates each have a respective offset plane offset and parallel to the base plane, wherein the first offset plane is raised above the at least one first plate in the stacking direction, wherein the second offset plane is recessed in the stacking direction.

2. The heat exchanger according to claim 1, wherein the base plane has at least two first openings through which a first medium passes, wherein the first and second offset planes each have at least two second openings through which a second medium passes.

3. The heat exchanger according to claim 1, wherein the at least one first plate and the at least one second plate have respective first and second structures, wherein the first structure rises above the at least one first plate in the stacking direction, wherein the second structure is recessed in the at least one second plate in the stacking direction.

4. The heat exchanger according to claim 1, wherein the at least one first plate and at least one second plate are stacked in an alternating sequence in the stacking direction, such that the base planes and the offset planes of the at least one first plate and the at least one second plate on one another and are joined to one another.

5. The heat exchanger according to claim 1, wherein the at least one first plate and the at least one second plate each have at least two domes, wherein the at least two first domes on the at least one first plate extend upward in the stacking direction, wherein the at least two second domes on the at least one second plate extend downward in the stacking direction, such that the at least two domes form transitions from the base plane to the offset planes.

6. The heat exchanger according to claim 5, wherein the at least one first plate and the at least one second plate each have a circumferential rim extending upward in the stacking direction, wherein the at least two domes are spaced apart from the circumferential rim.

7. The heat exchanger according to claim 2, wherein the heat exchanger has a longitudinal direction, wherein the first medium and the second medium flows between two adjacent plates of the at least one first plate and the at least one second plate parallel and/or diagonally to the longitudinal direction.

8. The heat exchanger according to claim 3, wherein the heat exchanger has a longitudinal direction and a lateral direction, wherein the first structure in the at least one first plate is offset longitudinally and/or laterally to the second structure in the at least one second plate.

9. The heat exchanger according to claim 3, wherein the first structure in the at least one first plate is rotated 180° about the stacking direction in relation to the second structure in the at least one second plate.

10. The heat exchanger according to claim 8, wherein there is an interrupted, domed rim surrounding each of the at least two openings.

11. A heat exchanger for a refrigerant circuit or a coolant circuit in a motor vehicle according to claim 1.

12. A heat exchanger, for a motor vehicle, comprising:

a stacking direction, at least one first plate, at least one second plate, wherein the at least one first plate and the at least one second plate comprise a raised circumferential lip about the periphery of the at least one first plate and the at least one second plate, wherein the raised circumferential lip about the periphery of at the least one first plate and the at least one second plate is configured to provide a seal between the at least one first plate and the at least one second plate, wherein the at least one first plate and the at least one second plate are adjacent to one another or on top of one another in the stacking direction, wherein the at least one first plate and the at least one second plate each have a base plane, wherein the at least two plates each have a respective offset plane offset and parallel to the base plane, wherein the first offset plane is raised above the at least one first plate in the stacking direction, wherein the second offset plane is recessed in the stacking direction, wherein the at least one first plate and at least one second plate are stacked in an alternating sequence in the stacking direction, such that the base planes and the offset planes of each of the at least one first plate and the at least one second plate bear on one another and are joined to one another wherein the base plane has at least two first openings through which a first medium passes, wherein the first and second offset planes each have at least two second openings through which a second medium passes.

13. The heat exchanger according to claim 12, wherein the at least one first plate and the at least one second plate each have at least two domes, wherein the at least two first domes on the at least one first plate extend upward in the stacking direction, wherein the at least two second domes on the at least one second plate extend downward in the stacking direction, such that the at least two domes form transitions from the base plane to the offset planes.

14. The heat exchanger according to claim 13, wherein the at least one first plate and the at least one second plate each have a circumferential rim extending upward in the stacking direction, wherein the at least two domes are spaced apart from the circumferential rim.

15. The heat exchanger according to claim 12, wherein the heat exchanger has a longitudinal direction and a lateral direction, wherein the first structure in the at least one first plate is offset longitudinally and/or laterally to the second structure in the at least one second plate.

16. The heat exchanger according to claim 12, wherein the first structure in the at least one first plate is rotated 180° about the stacking direction in relation to the second structure in the at least one second plate.

* * * * *